US007658643B2

(12) United States Patent
Tuerschmann et al.

(10) Patent No.: US 7,658,643 B2
(45) Date of Patent: Feb. 9, 2010

(54) CONNECTOR FASTENING ARRANGEMENT FOR PRINTED CIRCUIT BOARDS

(75) Inventors: Dieter Tuerschmann, Weiterstadt (DE); Michael Sturm, Altenstadt (DE); Dirk Hanke, Lemgo (DE); Manfred Domrath, Weener (DE)

(73) Assignee: Weidmuller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 12/079,764

(22) Filed: Mar. 28, 2008

(65) Prior Publication Data

US 2008/0248678 A1 Oct. 9, 2008

(30) Foreign Application Priority Data

Apr. 3, 2007 (DE) ..... 20 2007 005 013 U

(51) Int. Cl.
*H01R 13/60* (2006.01)

(52) U.S. Cl. ..... 439/564; 439/573

(58) Field of Classification Search ..... 439/564, 439/566, 567, 573
See application file for complete search history.

(56) References Cited

U.S. PATENT DOCUMENTS 3,768,064 A * 10/1973 Pabich ..... 439/370
4,827,609 A * 5/1989 Kawecki ..... 29/832
5,277,618 A * 1/1994 Mitra ..... 439/564
5,584,726 A * 12/1996 Le Gallic et al. ..... 439/573
6,102,735 A * 8/2000 Chen et al. ..... 439/573
6,866,524 B2 * 3/2005 Takata ..... 439/83
7,066,756 B2 6/2006 Lange et al.
2006/0094296 A1 * 5/2006 Edwards et al. ..... 439/573
2008/0232072 A1 * 9/2008 Edwards et al. ..... 361/759

FOREIGN PATENT DOCUMENTS

DE 103 55 456 A1 6/2005

* cited by examiner

*Primary Examiner*—Hien Vu
(74) *Attorney, Agent, or Firm*—Lawrence E Laubscher, Sr.; Lawrence E Laubscher, Jr.

(57) ABSTRACT

A connector fastening arrangement locks a connector housing to a printed circuit board, thereby to effect engagement between a resilient contact on the housing and a corresponding electrical element on the adjacent top surface of the printed circuit board. A rotary locking member carried by the connector housing extends within a locking bore contained in the adjacent surface of the printed circuit board, the locking member being rotatable between locked and unlocked positions relative to the connector housing. In a preferred embodiment, the locking bore is a through bore, and the locking member extends completely through the locking bore. When the locking member is rotated toward the locked position, an eccentric locking device carried by the extremity of the locking member extends in locking engagement beneath the bottom surface of the printed circuit board. In a second embodiment, the locking device comprises a bayonet fitting arrangement.

5 Claims, 5 Drawing Sheets

CONNECTOR FASTENING ARRANGEMENT FOR PRINTED CIRCUIT BOARDS

BACKGROUND OF THE INVENTION

1. Field of the Invention

A connector fastening arrangement locks a connector housing to a printed circuit board, thereby to effect engagement between a resilient contact on the housing and a corresponding electrical element on the adjacent top surface of the printed circuit board. A rotary locking member carried by the connector housing extends within a locking bore contained in the adjacent surface of the printed circuit board, the locking member being rotatable between locked and unlocked positions relative to the connector housing. In a preferred embodiment, the locking bore is a through bore, and the locking member extends completely through the locking bore. When the locking member is rotated toward the locked position, an eccentric locking device carried by the extremity of the locking member extends in locking engagement beneath the bottom surface of the printed circuit board. In a second embodiment, the locking device comprises a bayonet fitting arrangement.

2. Description of Related Art

As shown by the Lange et al U.S. Pat. No. 7,066,756, it has been proposed in the patented prior art to fasten a connector component to a printed circuit board by quick-operating snap fastener means.

The typical connector housing can be locked on a printed circuit board by means of catch pegs or special lugs, whereby when in the locked state, resilient contacts on the connector housing are in engagement with conductive elements on the printed circuit board. The contacting thus takes place in only one single connector block. There is no need for any additional pin board or socket board on the printed circuit board.

Although the known printed circuit board connectors have proven generally to operate satisfactorily, it was required to be to be further developed in terms of the manner of its assembly on the printed circuit board, and especially also with regard to the possibility of disassembly from the printed circuit board.

The present invention solves this problem by means of a connector having resilient contacts that engage corresponding contacts on a printed circuit board that preferably, whereby there is arranged on the housing furthermore at least one rotatable locking member that can be rotated around a longitudinal axis defined by an opening in the connector housing for locking the connector housing upon the printed circuit board by means of a rotary motion, or a combined rotational and axial motion.

Preferably, the locking means comprise a locking bolt that extends completely through the passage opening, whereby when in the locked position, it extends under the printed circuit board with the locking head on the side facing away from the housing.

According to a particularly advantageous variant, at least one locking bolt is formed as an eccentric bolt. By using these devices, it is possible, as always, to dispense with a counterpiece on the printed circuit board such as a pin strip or a solderable socket board and to accomplish in a relatively inexpensive manner contacting of the contact pads upon the printed circuit board without any soldering of the contacts together with the contact pads. The contacting is done quickly in a simple manner and securely, preferably with a tool such as a screwdriver with which the locking bars can preferably be fixed or separated with less than one complete rotation. Disassembly is achieved by releasing the locking means constitutes a special advantage here.

As an alternative, the locking means can also comprise a bayonet-type locking arrangement provided in each case within one of the passage openings. The procedure is even simpler, however, with the help of an eccentric bolt that beneath the printed circuit board when the eccentrically arranged the locking head is in the locking position.

SUMMARY OF THE INVENTION

Accordingly, a primary object of the invention is to provide a locking arrangement in which a rotatable locking member is displaced from an unlocked position toward a locked position, thereby to lock together the connector housing and the printed circuit board.

According to a more specific object, a plurality of resilient contacts on the connector housing are locked into engagement with corresponding conductive elements or pads on the printed circuit board, The rotary locking member serves to lock the connector member to the printed circuit board, thereby to effect electrical engagement between the resilient contacts and the conductive pads. When the locking member extends via a through bore completely through the printed circuit board, rotation of the locking member toward the locked position causes an eccentrically arranged locking device to extend in engagement with the bottom surface of the printed circuit board, thereby to lock together the connector housing and the printed circuit board. In a second embodiment, a bayonet-type fitting is used to lock the rotary locking member, and thus the connector housing, to the printed circuit board.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1A:
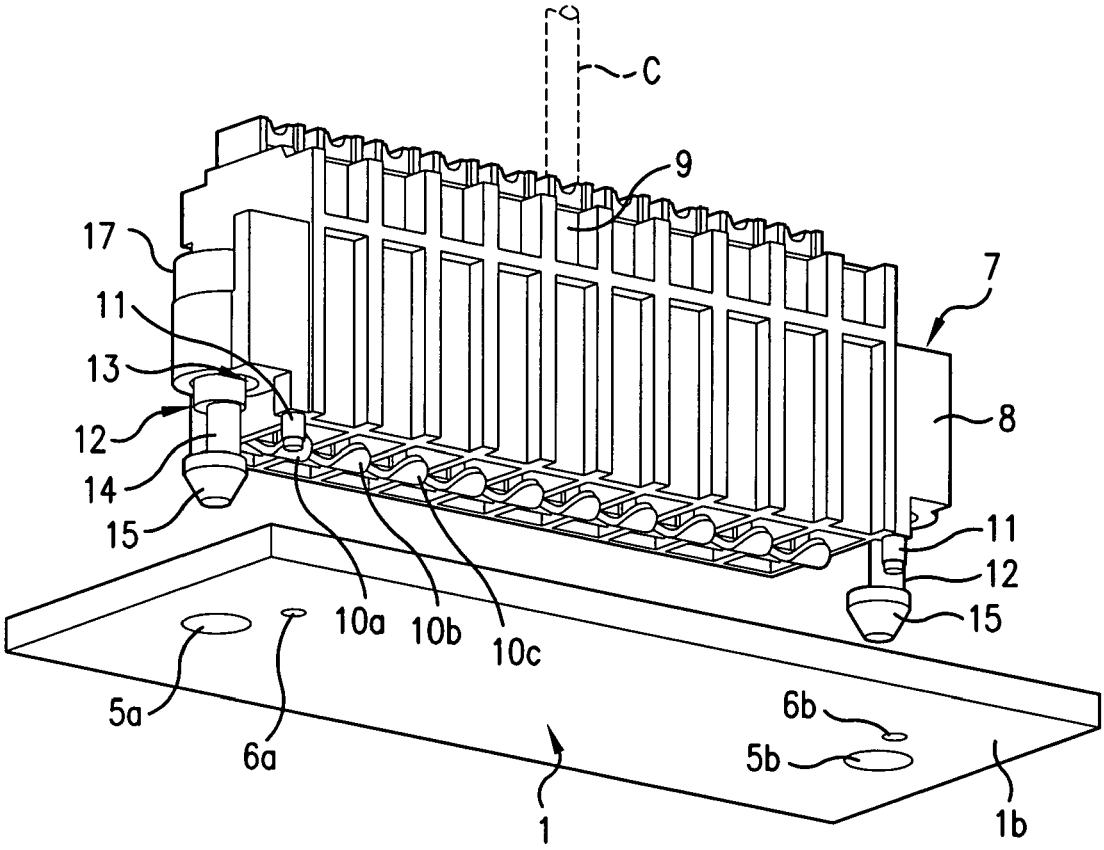
FIGS. 1*a* and 1*b* are bottom and top perspective views, respectively, of the connector housing and printed circuit board components prior to assembly.
Figure 1B:
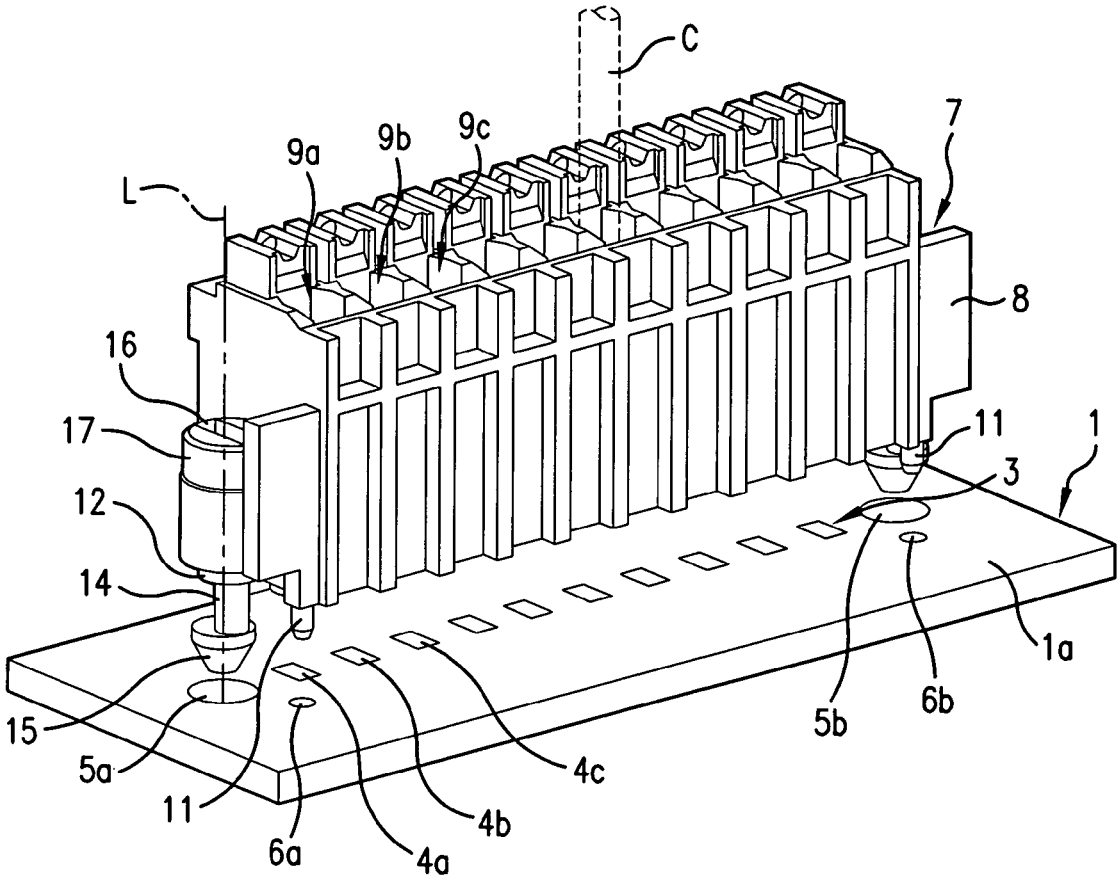
Figure 2:
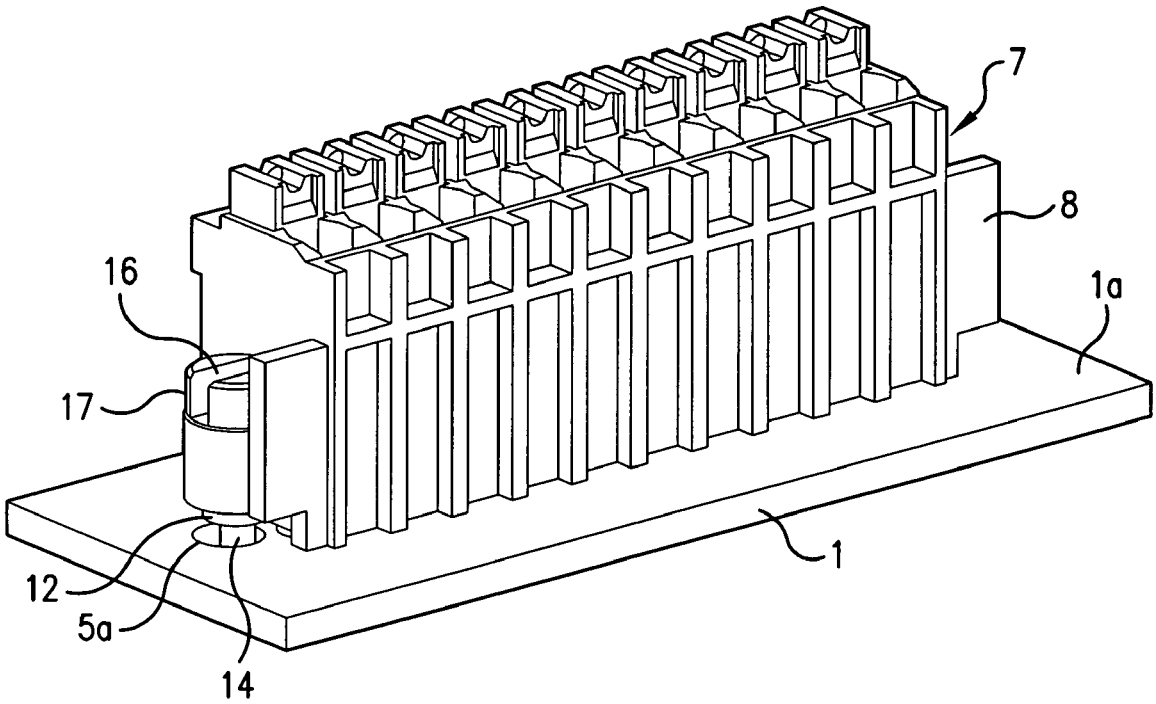
FIG. 2 is a top perspective view of the connector housing mounted on the printed circuit board.

FIG. 1 shows a printed circuit board 1 that is provided with a plurality of conductive elements 4 arranged in spaced relation in a row, for example, solder pads 4*a*, 4*b*, and 4*c*. etc. leading to various conductive printed circuits on the board.

At opposite ends of the row of 3 consisting of solder pads 4*a*, 4*b*, 4*c*, etc., there are provided by example, side by side, larger first through bores 5*a*, 5*b*, and second smaller locator openings 6*a*, 6*b*. To contact the solder pads 4*a*, 4*b*, 4*c*, etc. of the printed circuit board 1, one uses an electric connector 7 having a longitudinal housing 8 provided with a plurality of connector chambers 9*a*, 9*b*, 9*c*, etc. arranged in a row in a grid that corresponds to the grid of the solder pads 4 on the printed circuit board.

The connector chambers 9 are provided respectively with electrical terminals connected with the bare ends of the insulated conductors C. These terminals are in the form of compression springs, leaf springs, IDC contacts, or the like. Preferably, they are designed as compression spring contacts by way of the push-in technique.

Connector chambers 9 extend from the side of housing 8 that is remote from the printed circuit board 1, which chambers are also open at their other ends toward the printed circuit board 1. Protruding out of the connector housing 8 are a plurality of resilient contacts (i.e., leaf spring contact tongues) 10*a*, 10*b*, 10*c*, etc. on the side adjacent the printed circuit board, which resilient contacts are preferably connected with the screw terminals contained in the connector chambers and that are so spaced apart from each other that, when in the assembled state, they electrically engage the solder pads, 4*a*, 4*b*, 4*c*, etc., respectively.

One could also provide several rows of solders pads 4*a*, 4*b*, 4*c*, etc. and/or contacts 10*a*, 10*b*, 10*c*, etc. To the side adjacent the ends of the row consisting of resilient contacts 10*a*, 10*b*, 10*c*, etc., there is provided on the housing, on the one hand in each case, one positioning pin 11 that protrudes away from the housing 8 toward the printed circuit board 1 and that engages a smaller locator or positioning opening 6*a* or 6*b* and that in a supplementary fashion locates the connector housing relative to the printed circuit board.

To the side next to the ends of the row made of the resilient contacts 8*a*, etc., there is furthermore arranged on housing 8 a rotatable locking member 12 that can be rotated about the longitudinal axis L of an opening 13 contained in the contact housing 8 and which is designed for locking the printed circuit board connector 1 upon the printed circuit board.

Figure 3A:
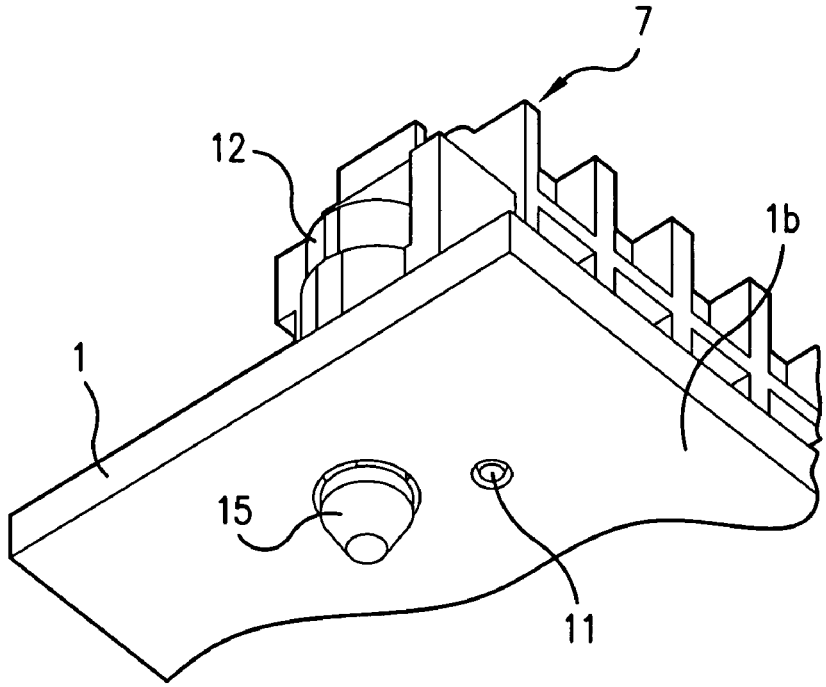
FIGS. 3*a* and 3*b* are detailed bottom views of the assembly when the rotatable locking member is in the unlocked and locked positions, respectively.
Figure 3B:
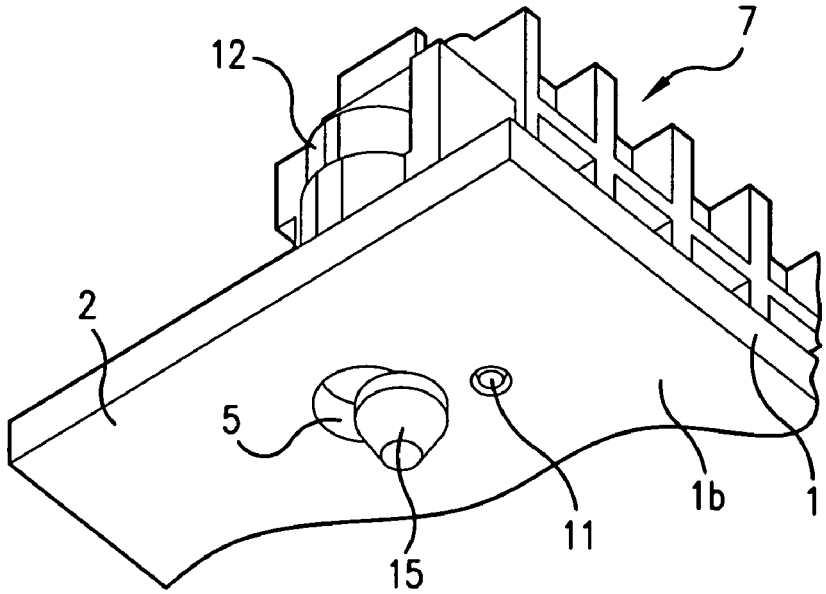

Here the locking member 12 is advantageously made as a eccentric bolt that, starting from a cylindrical intermediate segment 12*a* journaled in the opening 13 and whose longitudinal axis L forms the axis of rotation of the locking member 12. The locking member or bolt 12 has a crankpin-like configuration including an offset peg portion 14 that protrudes eccentrically with respect to the axis of rotation L and upon the extremity of which is molded or secured a locking device 15 that is so dimensioned and designed that it can be inserted through the oversized through bore 5*a*. The locking device 15 may be displaced the locked position of FIG. 3*b* by a rotational movement of the locking bolt 12 of less than 360°, in which position it extends under the bottom side 1*b* of the printed circuit board, thereby to lock the connector housing 8 to the printed circuit board. The contact force can now no longer lift the connector 7 from the printed circuit board. To release the connection of the housing 8 to the printed circuit board 1, the locking bolt 12 is simply rotated in the opposite direction.

Owing to the positioning pins 11, the connector will not slip relative to the printed circuit board during the turning of the eccentric locking bolts 12. Furthermore, in this manner, one can in this way prevent any false connection of an incorrect connector housing to a given printed circuit board.

Figure 4:
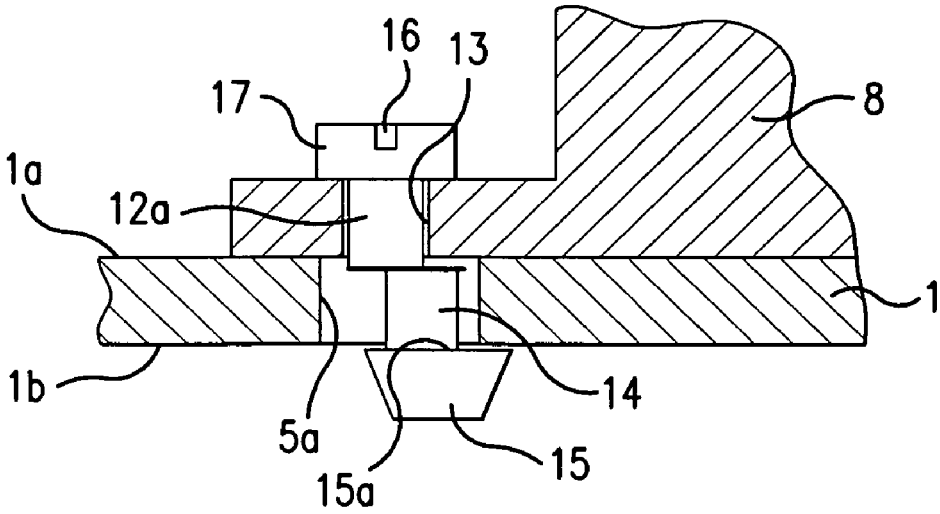
FIG. 4 is a detailed sectional view of a modification of the invention of FIGS. 1-3.

As the connector housing is mounted on the printed circuit board 1, the spring force of the contacts can be exerted by manually pressing the terminal onto the printed circuit board. According to an alternate solution, cam means in the form of a slanted cam surface 15*a* may be provided for displacing together the connector housing and the printed circuit board. Here, by means of suitable inclined generally-annular cam surfaces on the eccentric head portion 15, for example, a combined rotary and axial lifting movement takes place during the actuation of the eccentric locking bolts. In this way, the locking head 15, for example, can be provided with an inclined surface 15*a* in the circumferential direction so that the locking head 15 will be clamped on the bottom surface 1*b* of the printed circuit board, as shown in FIG. 4, Preferably, the locking head portion 15 has a conical configuration to facilitate introduction of the locking members into the oversized locking bores 5.

Preferably, the other ends of the locking bolt head portions 17 contain non-circular recesses 16 for receiving the operating tip of a rotary actuation tool, in particular, a screwdriver.

Figure 5:
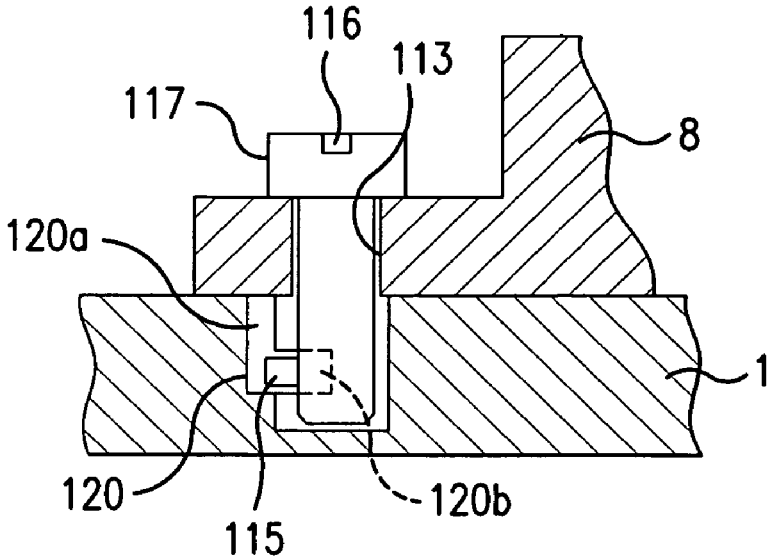
FIG. 5 is a detailed sectional view of a second embodiment of the invention incorporating bayonet fitting locking means.

Referring now to the embodiment of FIG. 5, the locking means for locking the connector housing 8 with the printed circuit board 101 is of the bayonet type including a rotary locking member 112 provided on its outer circumference with radially outwardly extending bayonet locking pin 115 that extends within a corresponding bayonet fitting groove 120 formed in the inner circumferential surface of the locking bore 105*a*. The bayonet groove 120 has a longitudinal portion 120*a*, and a circumferentially extending locking portion 120*b* that receives the locking pin when the rotary locking member 115 is in its locked position.

While in accordance with the provisions of the Patent Statutes the preferred forms and embodiments of the invention have been illustrated and described, it will be apparent to those skilled in the art that changes may be made without deviating from the invention described above.

What is claimed is:

1. A connector fastening arrangement for printed circuit boards, comprising:

(a) a printed circuit board (1) having planar horizontal upper and lower surfaces (1*a*, 1*b*), said upper surface being provided with at least one stationary conductive element (4*a*, 4*b*, 4*c*);

(b) connector means (7) including a connector housing (8) carrying at least one electrical contact (10*a*, 10*b*, 10*c*); and (c) locking means for locking said connector housing to said printed circuit board upper surface at a position in which said electrical contact is in engagement with said conductive element, said locking means including:

(1) at least one vertical locking member (12) connected with said connector housing for rotation about a longitudinal axis (L) normal to said printed circuit board, said locking member being rotatable about said longitudinal axis between locked and unlocked positions relative to said connector housing;

(2) said locking member having an integral generally crank-shaped configuration including:

(a) a cylindrical first portion (12*a*) mounted in a first through opening (13) contained in said connector housing for rotation about said longitudinal axis, said first cylindrical portion having upper and lower ends;

(b) an upper enlarged head portion (17) connected with the upper end of said cylindrical first portion, said upper head portion being seated on the adjacent surface of said connector housing and containing means (16) for rotating said locking member between said locked and unlocked positions, respectively;

(c) an eccentric peg portion (14) having an upper end connected with the lower end of said first cylindrical portion, said eccentric peg portion being parallel with and laterally offset from said longitudinal axis and having a lower end extending within a second through opening (5*a*) contained in said printed circuit board opposite said first through opening, said second through opening being circular and oversized relative to said first though opening; and (d) a lower enlarged head portion (15) connected with said peg portion lower end, said lower head portion having a generally horizontal upper surface (15*a*) that is in engagement with the bottom surface of said printed circuit board when said locking member is in said locked position.

2. A connector fastening arrangement for printed circuit boards, comprising:

(a) a printed circuit board (1) having planar horizontal upper and lower surfaces (1*a*, 1*b*, said upper surface being provided with at least one stationary conductive contact pad (4*a*, 4*b*, 4*c*);

(b) connector means (7) including a connector housing (8) carrying at least one resilient electrical contact (10*a*, 10*b*, 10*c*); and (c) locking means for locking said connector housing to said printed circuit board upper surface at a position in which said resilient electrical contact is biased toward engagement with said contact pad, said locking means including:

(1) at least one vertical locking member (12) connected with said connector housing for rotation about a longitudinal axis (L) normal to said printed circuit board, said locking member being rotatable about said longitudinal axis between locked and unlocked positions relative to said connector housing;

(2) said locking member having an integral generally crank-shaped configuration and including:

(a) a cylindrical first portion (12*a*) mounted in a first through opening (13) contained in said connector housing for rotation about said longitudinal axis, said first cylindrical portion having upper and lower ends;

(b) an upper enlarged head portion (17) connected with the upper end of said cylindrical first portion, said upper head portion being seated on the adjacent surface of said connector housing and containing means (16) for rotating said locking member between said locked and unlocked positions, respectively;

(c) an eccentric peg portion (14) having an upper end connected with the lower end of said first cylindrical portion, said eccentric peg portion being parallel with and laterally offset from said longitudinal axis and having a lower end portion extending within a second through opening (5*a*) contained in said printed circuit board opposite said first through opening, said second through opening being circular and oversized relative to said first though opening;

(d) a lower enlarged head portion (15) connected with said peg portion lower end, said lower head portion having a generally horizontal upper surface (15*a*) that is in engagement with the bottom surface of said printed circuit board when said locking member is in said locked position, said lower enlarged head portion having a conical configuration that converges in the direction downwardly from said connector housing thereby, to facilitate the insertion of said lower enlarged head portion relative to said second through bore when said locking member is in said unlocked position; and (f) generally annular cam means (15*a*) carried by the upper surface of said lower enlarged head portion upper surface for displacing together said printed circuit board and said connector housing when said locking member is rotated toward said locked position.

3. A connector fastening arrangement as defined in claim 2, and further including locator pins (11) arranged on said housing for cooperation with corresponding locator openings (6*a*, 6*b*) contained in said printed circuit board, thereby to position said housing with said electrical contact opposite said electrical element.

4. A connector fastening arrangement as defined in claim 2, wherein a plurality of said resilient contacts are arranged in a row extending longitudinally of said connector housing; wherein a plurality of said contact pads are arranged in a corresponding parallel row (3) on said printed board first planar surface; and further wherein two of said locking members are rotationally connected with said connector housing at opposite ends of said row of resilient contacts.

5. A connector fastening arrangement as defined in claim 4, wherein said contact housing contains a plurality of conductor chambers (9*a*, 9*b*, 9*c*) affording passage for electrical conductors having first ends connected with said electrical contacts, respectively.

* * * * *